US007552772B2

(12) United States Patent
Carmody et al.

(10) Patent No.: US 7,552,772 B2
(45) Date of Patent: Jun. 30, 2009

(54) LOCATING RECESS IN A SHOE FOR EXPANDABLE LINER SYSTEM

(75) Inventors: Michael A. Carmody, Houston, TX (US); Matthew J. Jabs, Houston, TX (US); Harold E. Payne, Tomball, TX (US); Mark K. Adam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/521,285

(22) Filed: Sep. 14, 2006

(65) Prior Publication Data

US 2007/0007011 A1 Jan. 11, 2007

Related U.S. Application Data

(63) Continuation of application No. 10/771,966, filed on Feb. 4, 2004, now Pat. No. 7,240,731.

(60) Provisional application No. 60/444,816, filed on Feb. 4, 2003.

(51) Int. Cl.
*E21B 29/00* (2006.01)

(52) U.S. Cl. ..... 166/285; 166/207; 166/380; 166/297

(58) Field of Classification Search ..... 166/117.4, 166/282.4, 382, 285
See application file for complete search history.

(56) References Cited

U.S. PATENT DOCUMENTS

| | | | | |
|---|---|---|---|---|
| 6,186,234 | B1 | 2/2001 | Hailey | |
| 6,286,597 | B1 | 9/2001 | Forsyth et al. | |
| 6,302,205 | B1 | 10/2001 | Ryll | |
| 6,513,598 | B2 | 2/2003 | Moore et al. | |
| 6,655,459 | B2 | 12/2003 | Mackay | |
| 6,843,322 | B2 | 1/2005 | Burtner et al. | |
| 6,845,820 | B1 | 1/2005 | Hebert et al. | |
| 7,163,057 | B2 * | 1/2007 | Hebert et al. | 166/285 |
| 7,240,731 | B2 * | 7/2007 | Carmody et al. | 166/285 |

(Continued)

FOREIGN PATENT DOCUMENTS

| | | |
|---|---|---|
| WO | WO 02/33212 A1 | 4/2002 |

OTHER PUBLICATIONS

Chapman, Walt, "Case History of One-Trip Monobore Completion System—2 Years of Cement-Through Monobore Completions in the Gulf of Thailand", SPE 103668, 2006, 1-6.

(Continued)

*Primary Examiner*—Richard E Chilcot, Jr.
*Assistant Examiner*—Matthew J Smith
(74) *Attorney, Agent, or Firm*—Steve Rosenblatt

(57) ABSTRACT

An apparatus to protect the mounting area of casing when subsequently attaching a tubular is disclosed. A sleeve that defines a sealed cavity having a loose incompressible material inside covers the mounting location on the casing. The cementing of the casing takes place through the sleeve. After the cementing, the sleeve is drilled out and the incompressible material is removed to the surface with the drill cuttings. A tubular is inserted in the casing and is preferably expanded into sealing contact with the mounting location on the casing. At the end of expansion, the run in shoe on the tubular is retrieved.

3 Claims, 7 Drawing Sheets

U.S. PATENT DOCUMENTS

| | | | |
|---|---|---|---|
| 2002/0033261 | A1 | 3/2002 | Metcalfe |
| 2005/0171248 | A1 | 8/2005 | Li et al. |

OTHER PUBLICATIONS

Stockmeyer, C.F., et al., "Development and Commercial Deployment of an Expandable Monobore Liner Extension", SPE102150, 2006, 1-14.

Ibrahim, Indra C., et al., Hybrid Monobore Completion Design: An Application for Multilayer Reservoir, SPE 88525, 2004, 1-6.

Taoutaou, Salim, et al., "New Approach to Ensure Long-Term Zonal Isolation for Land Gas Wells Using Monobore Cemented Completion", SPE 107433, 2007, 1-7.

Chapman, Walt, "Using Monobore System to Lower Completion Costs in Short-Life Wells", SPE 113315, 2008, 1-7.

Chapman, W., "Disposable Wells: A Monobore One Trip Case Study", SPE 97668, 2005, 1-6.

* cited by examiner

LOCATING RECESS IN A SHOE FOR EXPANDABLE LINER SYSTEM

PRIORITY INFORMATION

This application is a continuation application claiming priority from U.S. application Ser. No. 10/771,966, filed on Feb. 4, 2004, now U.S. Pat. No. 7,240,731, issued Jul. 10, 2007 which claims the benefit of U.S. Provisional Application No. 60/444,816 filed on Feb. 4, 2003.

FIELD OF THE INVENTION

The field of this invention is the method of running a tubular inside casing and securing it and more particularly to techniques for protecting the mounting location for the tubular on the casing as the casing is cemented.

BACKGROUND OF THE INVENTION

FIG. 1 is illustrative of the prior techniques of running in casing with a casing shoe 16 near its lower end. If later a tubular is run in and needs to be attached to the casing by expansion, the presence of cement debris in the support area on the casing where the tubular will be attached could prevent a sealed connection from being obtained. One way around that would be to deliver the cement into a shoe mounted below the point at which the liner will be attached later. Another method would be to run brushes and scrapers into the mounting location after cementing to be sure it was clean so that a good seal and support for the tubular subsequently installed can be obtained. However these techniques require significant amounts of time and create an associated cost.

The present invention protects the mounting location on the casing during cementing with a sleeve that covers a recess. The sleeve defines a sealed annular space that contains an incompressible material. This allows the sleeve to be compliant to changes in hydrostatic pressure as the casing is lowered into place. Cementing is done through the sleeve. The sleeve is subsequently drilled out exposing a recess and a locating groove. The tubular can then be positioned accurately and expanded in to sealing contact with the casing. Due to the recess, the drift diameter of the tubular after expansion into the recess is at least as large as the casing drift diameter. The entire tubular can be expanded to its lower end and a run in shoe at the lower end of the tubular can be retrieved and removed from the well with the swaging assembly and the running string that delivered it. These advantages and others of the present invention will be readily appreciated by those skilled in the art from a review of the description of the preferred embodiment and the claims that appear below.

SUMMARY OF THE INVENTION

An apparatus to protect the mounting area of casing when subsequently attaching a tubular is disclosed. A sleeve that defines a sealed cavity having a loose incompressible material inside covers the mounting location on the casing. The cementing of the casing takes place through the sleeve. After the cementing, the sleeve is drilled out and the incompressible material is removed to the surface with the drill cuttings. A tubular is inserted in the casing and is preferably expanded into sealing contact with the mounting location on the casing. At the end of expansion, the run in shoe on the tubular is retrieved.

DETAILED DESCRIPTION OF THE DRAWINGS

Figure 16A:
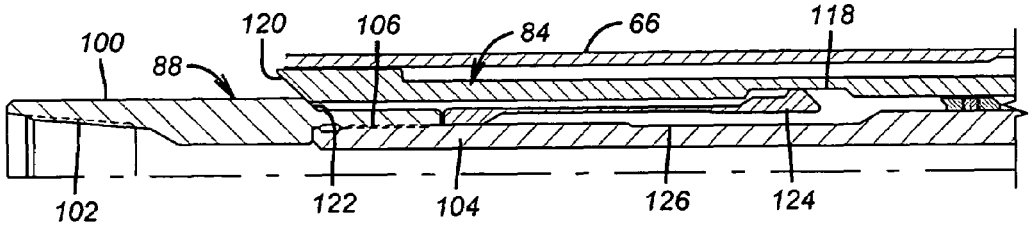
Figure 17A:
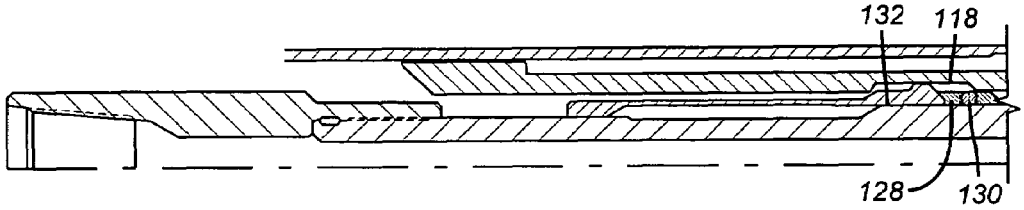
Figure 18A:
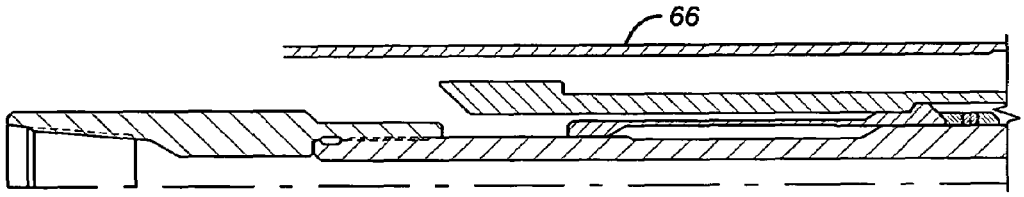
Figure 16B:
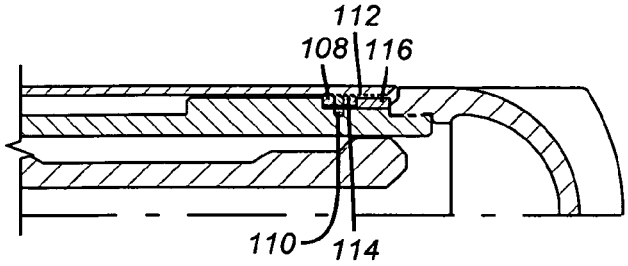
Figure 18B:
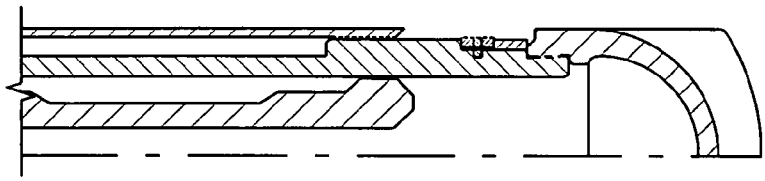
Figure 18B:
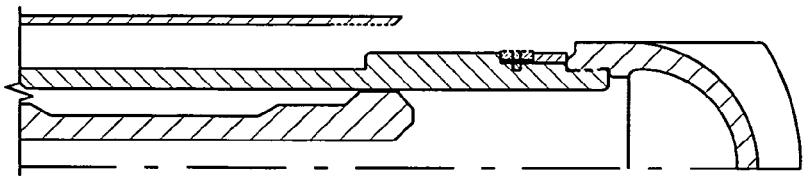

FIGS. 16*a*-16*b* show the capture of the guide nose assembly;

FIGS. 17*a*-17*b* show the shearing out of the guide nose assembly from the tubular or liner;

FIGS. 18*a*-18*b* show the guide nose fully released and captured; and

Figure 19A:
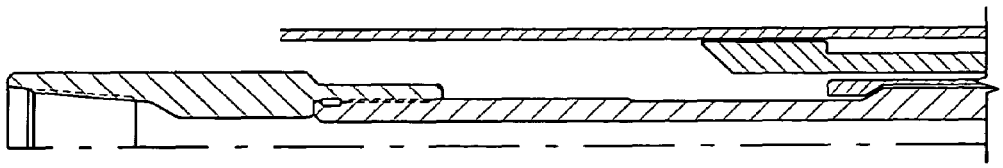
Figure 19B:
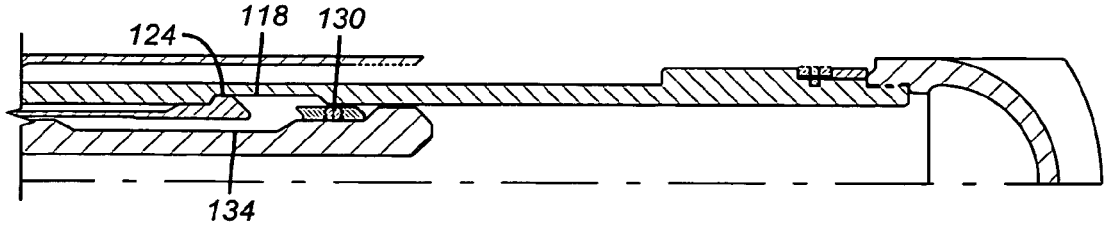

FIGS. 19*a*-19*b* show the emergency release feature.

DETAILED DESCRIPTION OF THE PREFERRED EMBODIMENT

Figure 1:
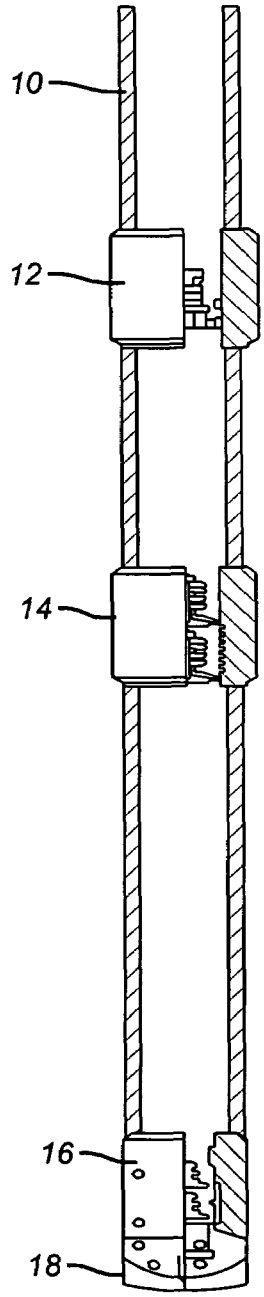
(PRIOR ART) FIG. 1
FIG. 1 is a prior art production casing illustrating a standard casing shoe at the lower end.

FIG. 1 illustrates a production casing 10 having a known landing collar 12 and a standard float collar 14 as well as a casing shoe 16 adjacent its lower end 18. Typically, in the past, the cement is pumped through the casing shoe 16 and then a dart or wiper is used to displace cement from the casing 10 and out through the shoe 16 and into the surrounding annulus. When the well is to be drilled deeper, the shoe 16 is drilled out but residual cement could still be present. The presence of such cement or shoe debris after drilling can affect the seal that is subsequently needed when a liner is inserted and secured to the casing 10. This is particularly a concern when the liner is to be expanded to secure it to the casing 10.

Figure 2:
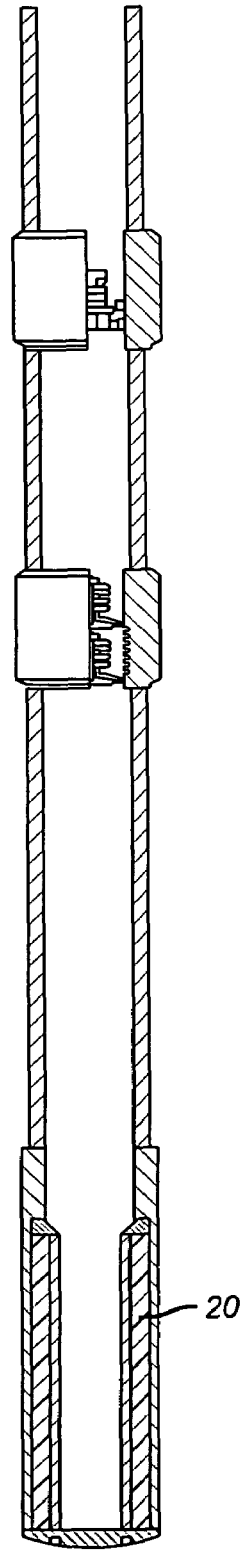
FIG. 2 shows a production string with the shoe track of the present invention.
Figure 15:
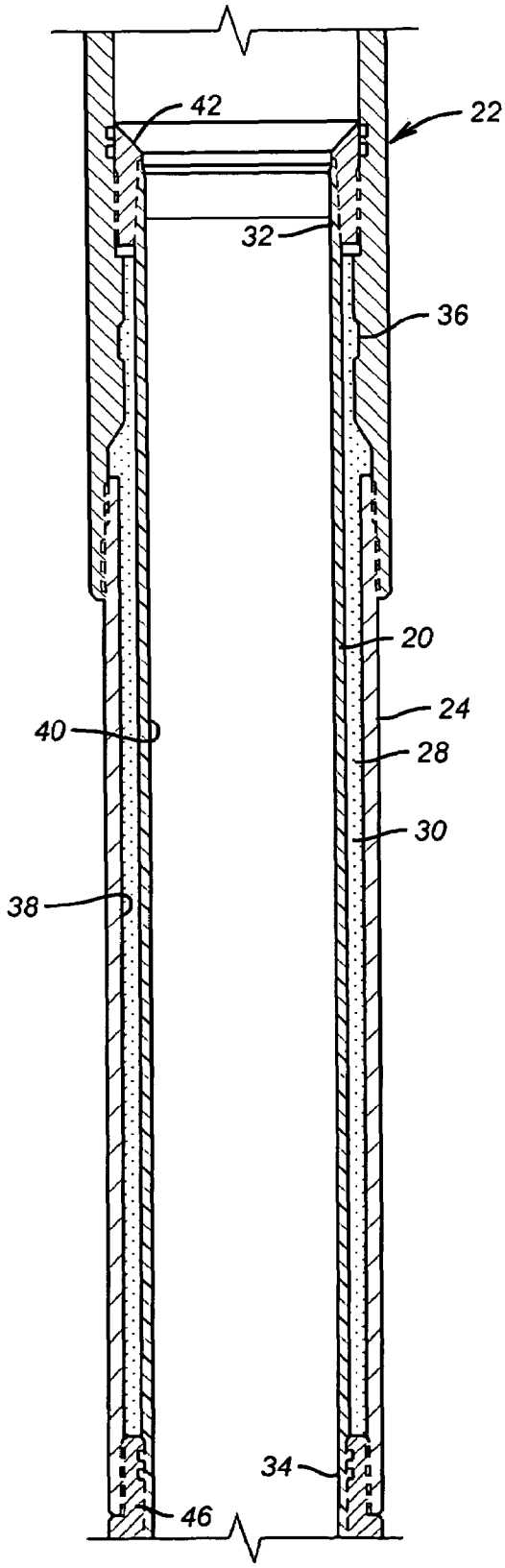
FIG. 15 is a close up view of the sleeve protecting the recessed shoe during cementing.

The present invention addresses this concern with a sleeve 20 shown in FIGS. 2 and 15. As shown in FIG. 15, the production casing 22 has a lower section 24. Inside section 24 is a sleeve 20 mounted preferably concentrically and defining an annular space 28 that contains an incompressible material 30. Preferably the incompressible material 30 is loosely mounted sand but other materials can be used. The purpose of the material 30 is to allow flexing in response to increasing hydrostatic pressures as the depth of the casing 22 increases, when it is lowered into initial position. Sleeve 20 is preferably fiberglass sealed at ends 32 and 34. Sleeve 20 initially covers locating recess 36 and long recess 38, which will later serve as the location for securing a tubular such as a liner by a variety of methods. The preferred method of expansion will be described in more detail below. Sleeve 20 is preferably a non-metallic or some other material that can be quickly drilled such as plastics or composites, to mention a few. During cementing of the casing 22, the sleeve 20 has an inner surface 40, which is contacted by the cement. Ultimately a dart or wiper plug 42 passes through casing 22 and lands on landing collar 12 (see FIG. 4) to displace most of the cement out of the casing 22 and into the surrounding annulus. The sleeve 20 is subsequently drilled out allowing the incompressible material 30 to escape and exposing the clean locating recess 36 and the long recess 38 for subsequent attachment of a tubular as will be described below. The drilling removes a part of seal rings 42 and 46 without damaging the casing 22 or lower section 24.

Figure 3:
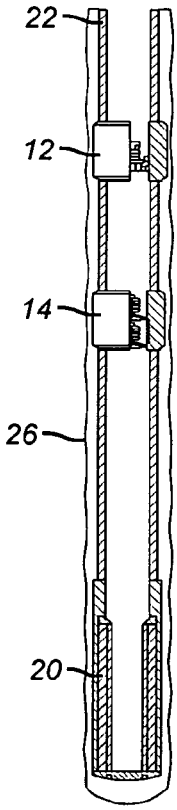
FIG. 3 shows the production casing with the shoe track of the present invention run into the wellbore.

The method can be understood by beginning at FIG. 3, where the casing 22 is mounted in the desired position for cementing in the wellbore 26. The assembly includes landing collar 12 and float collar 14. The assembly shown in FIG. 15 is at the lower end of the assembly, but for clarity only the sleeve 20 is referenced in the schematic illustration.

Figure 4:
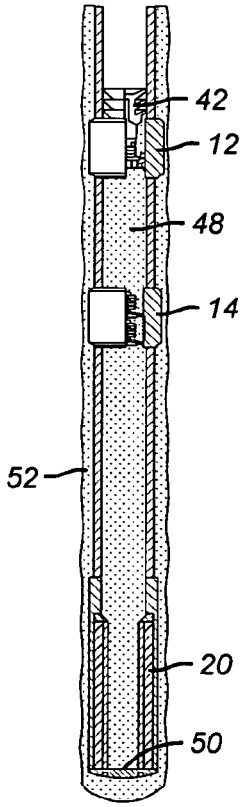
FIG. 4 is the view of FIG. 3, after cementing.

FIG. 4 shows that cement 48 has been displaced by plug 42 landing on landing collar 12. As a result, cement 48 is pushed through sleeve 20, through run in shoe 50 and into annulus 52.

Figure 5:
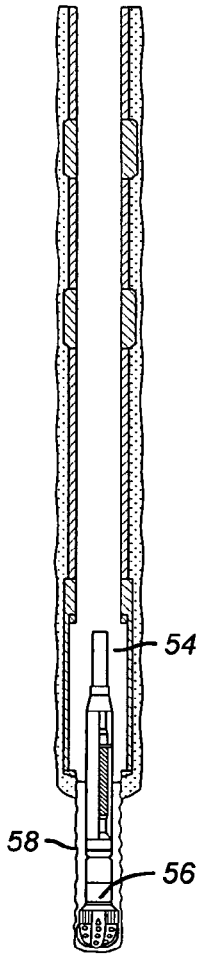
FIG. 5 is the view of FIG. 4 showing the shoe track exposed after drillout and the wellbore extended below the production casing.

In FIG. 5, a drill string 54 with a bit assembly 56 has been advanced through the casing 22 and has milled out the wiper 42 and the sleeve 20 to expose locating recess 36 and long recess 38. The incompressible material 30 is released and circulated to the surface with the drill cuttings from the action of bit assembly 56.

Figure 6:
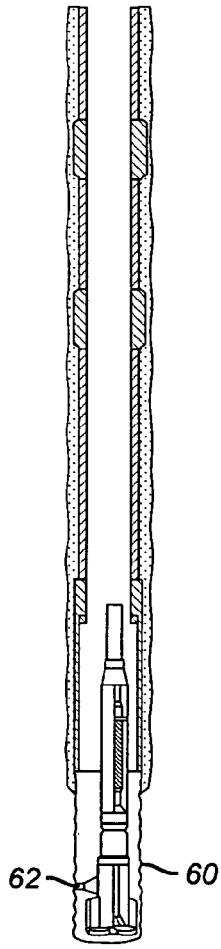
FIG. 6 is the view of FIG. 5 showing the reaming of the extension bore just drilled.
Figure 7:
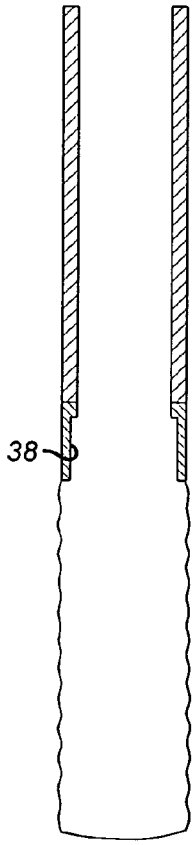
FIG. 7 is a close up view of the now exposed shoe.

FIG. 6 illustrates the enlarging of the new section of wellbore 58 to a new dimension 60 using an under-reamer or an RWD bit 62. Depending on the nature of the bit assembly 56, the wellbore 60 can be created in a single trip in the hole or in multiple trips. FIG. 7 shows the drilling of wellbore 60 complete and the string 54 and bit assembly 56 removed from the wellbore 60 and stored at the surface.

Figure 8:
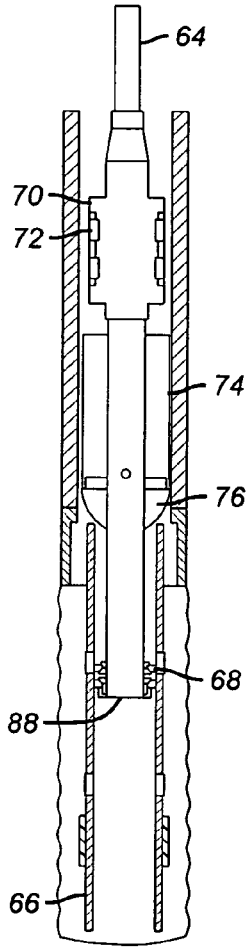
FIG. 8 shows the liner run in on a running tool and in position to be expanded.
Figure 9:
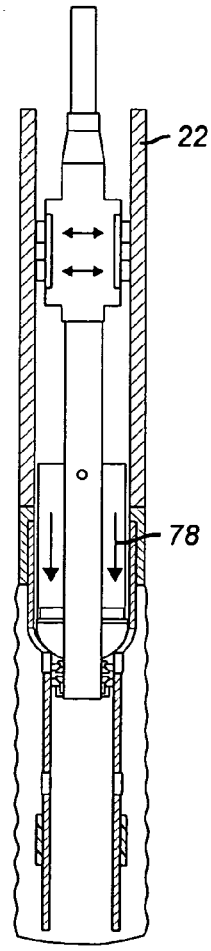
FIG. 9 is the view of FIG. 8 indicating the initial stroking of the swage, which results in release from the running tool.
Figure 10:
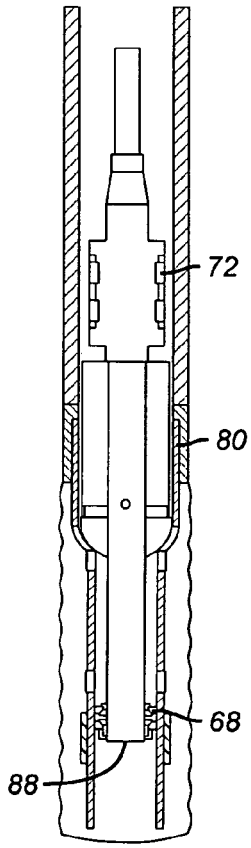
FIG. 10 is the view of FIG. 9 showing the anchor released and weight being set down to reposition for the next stroke of the swage.
Figure 11:
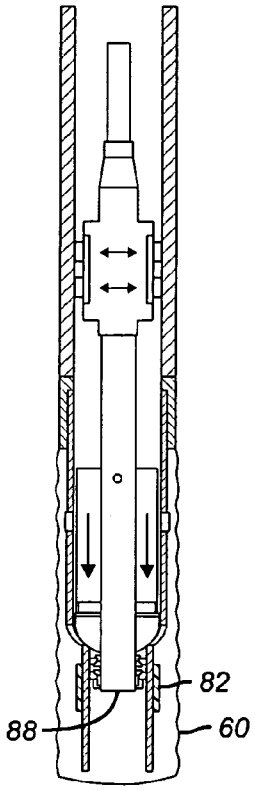
FIG. 11 is the view of FIG. 10 showing-the next stroke of the swage.

FIG. 8 shows a running string 64 that supports a liner or other tubular 66 at locking dogs 68. The assembly further comprises an anchor 70 with slips 72 that are preferably pressure sensitive to extend slips 72 and allow them to retract when pressure is removed. Also in the assembly is a piston and cylinder combination 74 that drives a swage 76, in response to pressure applied to the piston and cylinder combination 74. Initially, as illustrated in FIG. 9, pressure is applied to extend the slips 72 and drive down the swage 76 as illustrated schematically by arrows 78. The upper end 80 of the tubular 66 is expanded into long recess 38 for support from casing 22. As swage 76 stroked enough to suspend the tubular 66 to casing 22 the dogs 68 become undermined and release their grip on tubular 66. As shown in FIG. 10, the dogs 68 have released and the slips 72 have been released. When weight is set down at the surface, after internal pressure is removed, the piston and cylinder combination 74 is re-cocked for another stroke for swage 76. FIG. 11 shows the subsequent stroking, further expanding the tubular 66. Optionally, one or more open hole packers 82 can be used to ultimately make sealing contact in wellbore 60 after expansion.

Figure 12:
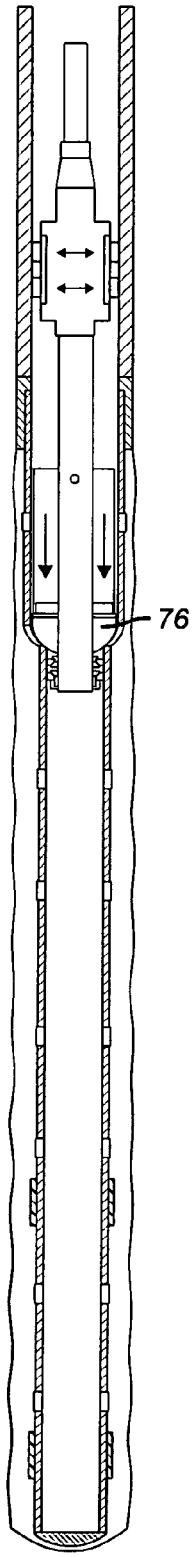
FIG. 12 is the view of FIG. 11 showing the swage advancing toward the lower end of the liner.
Figure 13:
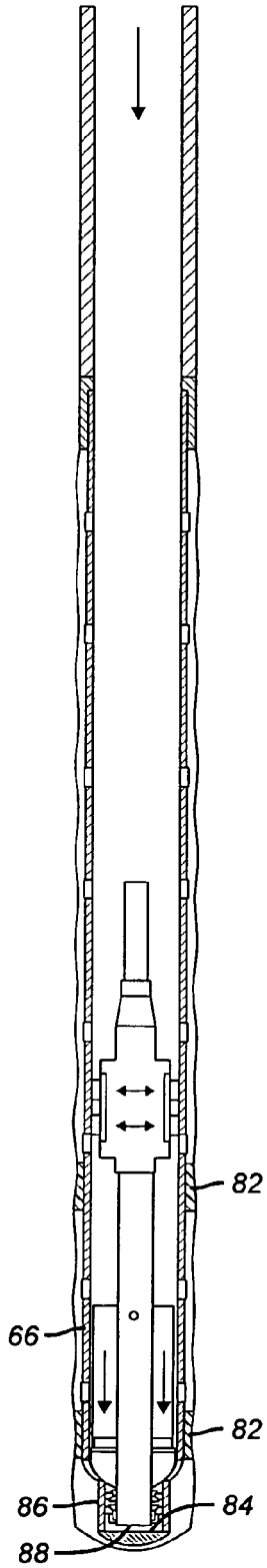
FIG. 13 is the view of FIG. 12 with the swage now engaging the running shoe of the liner at its lower end.

FIG. 12 illustrates the continuation of the movement of the swage in response to applied surface pressure to anchor 70 and piston and cylinder combination 72. Those skilled in the art will appreciate that force magnification can be incorporated into piston and cylinder combination 72 and a greater force can be applied to swage 76 at the beginning of each stroke as compared to the balance of each stroke. These features were disclosed in co-pending U.S. application Ser. No. 60/265,061 whose filing date is Feb. 11, 2002 and whose contents are fully incorporated herein as if fully set forth. However, other techniques can be used for swaging or even to secure the tubular 66 to long recess 38 or another location initially covered by a sleeve such as 20 during cementing of the casing 22, without departing from the invention.

Figure 14:
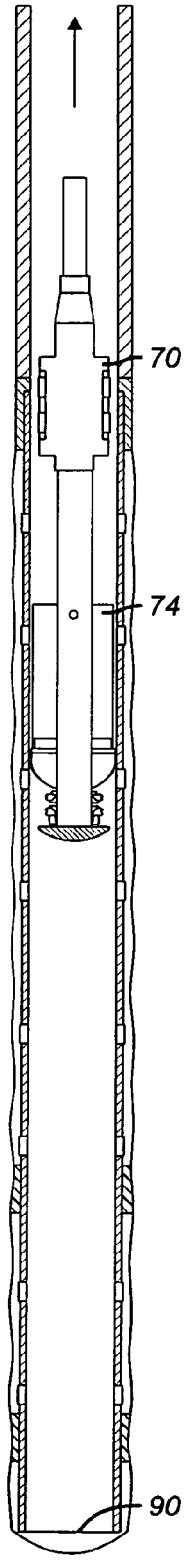
FIG. 14 is the view of FIG. 13 with the liner fully expanded and the swage being removed with the running shoe by withdrawing the running tool from the fully expanded liner.

Eventually, the running string 64 expands the open hole packers 82 into sealing contact with the wellbore 60 as it approaches the run in shoe 84 mounted near the lower end 86 of tubular 66. A grasping mechanism 88 is shown schematically at the lower end of running string 64. Contact is made and the run in shoe 84 is grabbed by mechanism 88. Swage 76 expands lower end 86 of tubular 66 enough so that the run in shoe is released. When the string 64 is removed from the wellbore 60 and to the surface, it takes with it the anchor 70, the piston and cylinder combination 74 and the run in shoe 84, leaving a large opening 90 in the lower end of tubular 66, as shown in FIG. 14. Those skilled in the art will appreciate that the run in shoe 84 facilitates insertion of the tubular 66 by presenting a blunt nose as the tubular is initially advanced into position, as shown in FIG. 8. It has a valve in it to allow circulation to facilitate insertion of the tubular 66. Removal of the run in shoe 84 as described above presents a large opening in the lower end of the tubular 66 to facilitate subsequent drilling operations or other completion techniques.

FIGS. 16-19 show the grasping mechanism 88 in greater detail. It has a top sub 100 connected at thread 102 below dogs 68. Top sub 100 is connected to mandrel 104 at thread 106. The run in shoe 84 is attached to tubular 66 by virtue of split ring 108 held against rotation by pin 110, which extends from shoe 84. Threads 112 on ring 108 mesh with threads 114 on tubular 66. Ring 116 holds ring 112 in position on shoe 84. Shoe 84 has a groove 118 and a stop surface 120. Top sub 100 has a surface 122 that lands on surface 120 as the grasping mechanism 88 advances with the swage 76. When surface 122 hits surface 120 the tubular 66 has not yet been expanded. Mandrel 104 has a series of gripping collets 124 that land in groove 118 when surfaces 120 and 122 connect. When this happens, as shown in FIG. 16*a* the collets are aligned with recess 126 on mandrel 104 so that they can enter recess 118 in shoe 84. Mandrel 104 has a ring 128 held on by shear pins 130. When a downward force is applied to shoe 84 through the contact between surfaces 120 and 122, threads 112 and 114 shear out and the shoe 84 drops down and is captured on ring 128. At this point, shown in FIG. 17*a*, surface 132 on mandrel 104 supports collets 124 in groove 118. The shoe 84 is now captured to the mandrel 104. As the mandrel 104 moves down in tandem with the swage 76, the tubular 66 is expanded to bottom. Thereafter, the swage 76 and the grasping mechanism 88 and the attached shoe 84 can all be removed to the surface, as shown in FIG. 18*a*. If, for any reason the shoe 84 fails to release from the tubular 66 or gets stuck on the way out to the surface, a pull on the string 64 shears out pins 130, allowing the collets 124 to become unsupported as surface 134 is presented opposite recess 118 as shown in FIG. 19*a*. Those skilled in the art will appreciate that other devices can be used to snare the shoe 84 as the swage 76 advances. The ability to remove shoe 84 is advantageous as it removes the need to mill it out and further reduces the risk of the shoe 84 simply turning in response to a milling effort, once it is no longer held against rotation by the now expanded tubular 66.

Those skilled in the art will now appreciate the advantages of the present invention. The sleeve 20 shields subsequent mounting locations for the tubular 66 on casing 22 from contamination with the cement 48 used to seal the casing 22. Thus regardless of the method of sealed attachment between the tubular 66 and the casing 22, there is a greater assurance that the proper sealing support will be obtained without concern that cement may have fouled the mounting location. The assembly including the sleeve 20 is compliant to changes in hydrostatic pressure resulting from advancement of the casing 22 downhole. At the conclusion of expansion or other technique to secure tubular 66 to casing 22, the lower end of the tubular 66 is left open as the run in shoe 84 is retrieved.

The foregoing disclosure and description of the invention are illustrative and explanatory thereof, and various changes in the size, shape and materials, as well as in the details of the illustrated construction, may be made without departing from the spirit of the invention.

We claim:

1. A well completion method, comprising:

running in a first tubular having a shoe at its lower end;

positioning a sleeve in close proximity to cover a recess assembly in said shoe, for said running in, said recess assembly comprising a tubular recess defined by the inner wall of said tubular having the largest diameter for subsequent support of a second tubular and further comprising a discrete locating recess for subsequent positioning of said second tubular in opposition to said tubular recess;

making said sleeve substantially as long as said recess assembly;

creating an annular space around said recess assembly with said sleeve, for said running in;

providing an incompressible material in said annular space, for said running in;

using a sealing material to seal the tubular downhole with said sleeve covering said recess assembly and being substantially exposed to the sealing material;

removing the sleeve after said sealing to expose said tubular recess and said locating recess.

2. The method of claim 1, comprising:

loosely packing said incompressible material.

3. The method of claim 2, comprising:

drilling out said sleeve after said sealing; and removing said incompressible material with the drill cuttings.

* * * * *